US008220087B2

(12) United States Patent
Villa et al.

(10) Patent No.: US 8,220,087 B2
(45) Date of Patent: Jul. 17, 2012

(54) EXERCISE MAT

(76) Inventors: Giovanni Villa, Los Angeles, CA (US); Bemnet Kibreab, Los Angeles, CA (US)

( * ) Notice: Subject to any disclaimer, the term of this patent is extended or adjusted under 35 U.S.C. 154(b) by 368 days.

(21) Appl. No.: 12/568,574

(22) Filed: Sep. 28, 2009

(65) Prior Publication Data

US 2011/0072581 A1 Mar. 31, 2011

(51) Int. Cl.
*A47G 9/06* (2006.01)
*A63B 26/00* (2006.01)

(52) U.S. Cl. ..... 5/420; 5/417; 482/23; 482/142

(58) Field of Classification Search ..... 5/420, 417, 5/419, 731–734, 652, 655.9, 740, 953, 657, 5/722, 723, 922, 925, 926; 482/23, 142, 482/148
See application file for complete search history.

(56) References Cited

U.S. PATENT DOCUMENTS 1,423,416 A * 7/1922 Gomes ..... 5/722
1,981,379 A * 11/1934 Thomson et al. ..... 606/237
3,626,526 A * 12/1971 Viel ..... 5/722
3,843,980 A * 10/1974 Rodriguez ..... 5/733
4,042,278 A * 8/1977 Jensen ..... 297/397
4,286,344 A * 9/1981 Ikeda ..... 5/717
4,421,110 A * 12/1983 DeLisle et al. ..... 601/134
4,584,730 A * 4/1986 Rajan ..... 5/632
4,606,087 A 8/1986 Alivizatos
5,481,771 A * 1/1996 Burk, IV ..... 5/636
5,524,640 A 6/1996 Lisak et al.
5,742,963 A 4/1998 Trevino et al.
5,822,817 A * 10/1998 Carew et al. ..... 5/732
5,937,465 A * 8/1999 Carew et al. ..... 5/732
5,963,998 A * 10/1999 Carew et al. ..... 5/655
6,026,525 A * 2/2000 Davis ..... 5/99.1
6,446,289 B1 9/2002 Su et al.
6,751,816 B1 6/2004 Wechsler
6,766,536 B1 7/2004 Aarons
6,877,176 B2 4/2005 Houghteling
6,920,655 B2 7/2005 Mitchell
7,207,932 B1 4/2007 Dean
7,955,224 B2 * 6/2011 Curley ..... 482/23
2004/0013853 A1 1/2004 Mandzsu et al.
2004/0250346 A1 12/2004 Vasishth
2006/0073305 A1 4/2006 Kole
2007/0275827 A1 11/2007 Glaser
2011/0072581 A1 * 3/2011 Villa et al. ..... 5/420
2012/0076981 A1 * 3/2012 Franks et al. ..... 428/138

OTHER PUBLICATIONS

International Searching Authority, Search Report for PCT/US2010/050290, Nov. 19, 2010, 21 pages, Alexandria.

* cited by examiner

*Primary Examiner* — Robert G Santos
(74) *Attorney, Agent, or Firm* — Cislo & Thomas, LLP

(57) ABSTRACT

An exercise comprising a mat and a plurality of supports strategically positioned for specific body parts. The supports may be integrally formed into the mat or removable. The exercise mat may further comprise a cover. The cover may have pockets or holes to receive the supports. In some embodiments, the cover and/or the top surface of the mat may comprise protuberances to reduce slippage. The bottom of the mat or the cover may be made from non-slip material.

23 Claims, 3 Drawing Sheets

EXERCISE MAT

TECHNICAL FIELD

This invention relates to exercise mats.

BACKGROUND

Exercises done on the floor are performed more comfortably with the use of a pad. The pad provides cushioning from the hard floor, a non-slip surface, and also demarcates the user's exercise area in the case of group exercises. The current exercise pads, however, are simple, flat, pliable pads. These pads, although providing general cushioning during the exercise, do not provide the requisite cushioning for isolated body parts that receive the greatest amount of pressure, such as the hands, the knees, and the feet. Creating a thicker pad would make the pad too cumbersome to carry.

Current pads focus on improving the transportability and anti-slip surfaces of the pad. Therefore, there is a need for a lightweight, transportable exercise mat that can provide the proper support and cushioning to body parts receiving the greatest amounts of stress and pressure without increasing the cumbersomeness of the exercise mat.

SUMMARY

The present invention is directed to an exercise mat that provides the proper cushioning for the exerciser. The exercise mat comprises a mat and a plurality of supports strategically positioned for specific body parts. In some embodiments, the supports may be removable. In some embodiments, the supports may be integrally formed into the mat. The exercise mat may further comprise a cover. The cover may have pockets to receive the supports. In some embodiments, the cover and/or the top surface of the mat may comprise protuberances to reduce slippage.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

Figure 1:
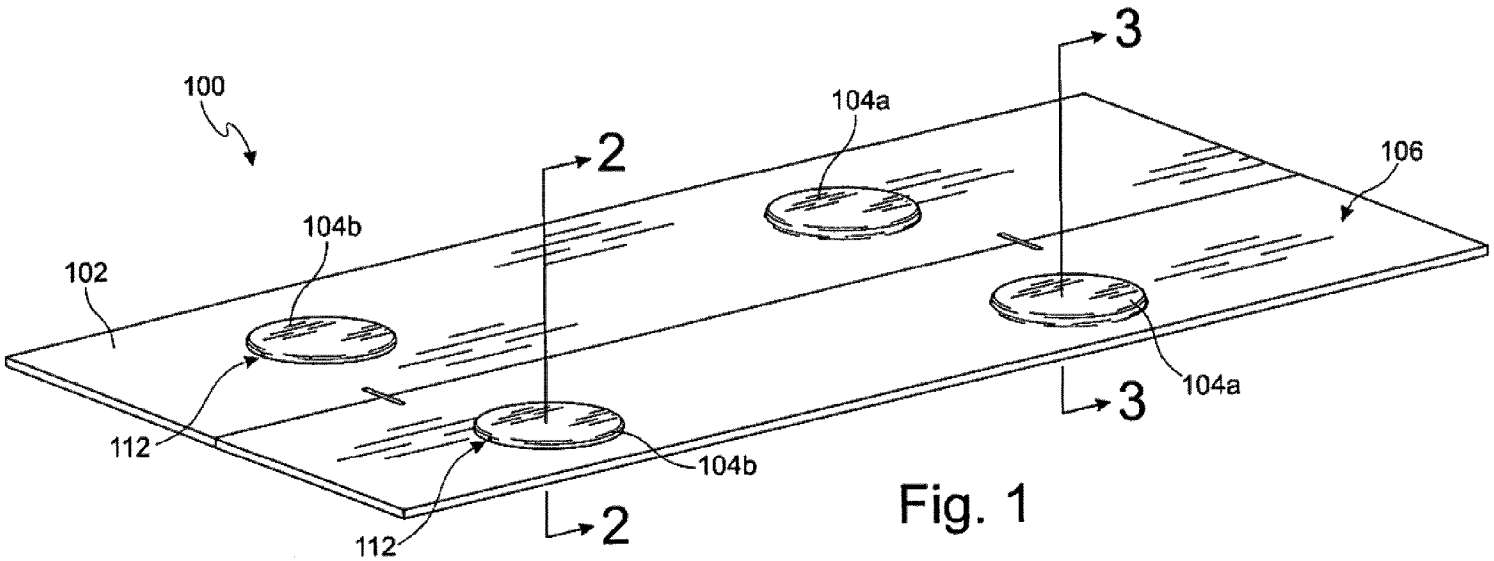
FIG. 1 shows a perspective view of an embodiment of the present invention.
Figure 2:
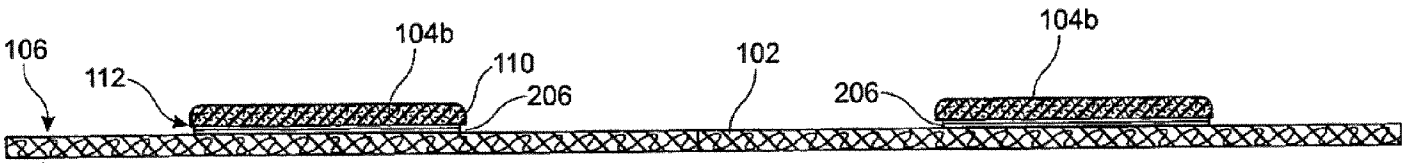
FIG. 2 shows a cross-sectional side view taken along 2-2 in FIG. 1.
Figure 3:
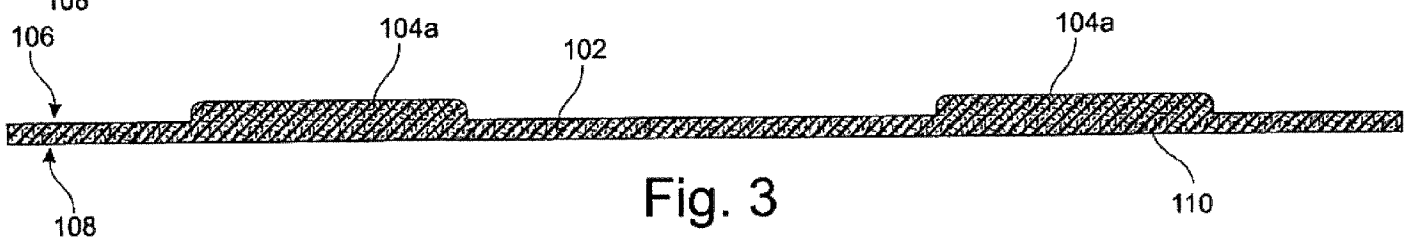
FIG. 3 shows a cross-sectional side view taken along 3-3 in FIG. 1.

With reference to FIGS. 1-3, the exercise mat 100 is designed to provide additional support and comfort to parts of an exerciser's limbs, such as the hands, wrists, elbows, knees, and feet during an exercise, such as yoga. The exercise mat 100 comprises a mat 102 having a plurality of supports 104 strategically positioned so as to accommodate the exerciser's upper and lower limbs.

The mat 102 provides a comfortable surface upon which the exerciser can perform his or her exercises. The mat 102 is generally rectangular in shape having a top surface 106 and a bottom surface 108 opposite the top surface 106. The mat 102 can be made in any other shape, such as round, oval, square, triangular, and the like and may come in a variety of sizes to accommodate exercisers of different heights and sizes.

In some embodiments, the mat 102 comprises a cushioning material 110. Suitable cushioning material 110 includes foam, rubber, gel, and any other material that can absorb shock. The top surface 106 may comprise material that is cushioning, comfortable to the touch, absorbent, or any combination thereof, such as textiles and fabrics, vinyl, rubber, silicone, plastics, polypropylene, polyurethane, synthetics, elastomers, polymers, and the like. In some embodiments, the top surface 106 may comprise material that is fluid impermeable so as not to soak up sweat that may accumulate on top of the mat during exercise. Such a material also facilitates cleaning the mat 102.

The bottom surface 108 may be integrally formed with the top surface 106 and, therefore, be made from the same material as the top surface 106. This also allows the mat 102 to be reversible so that the supports 104 can protrude from either side. In reversible embodiments, the supports 104 can be made to protrude out from the side opposite the floor, for example, by using fluid or loose material for the support 104. In some embodiments, the bottom surface 108 may be made from a different material and fastened to the top surface 106, for example by stitching or adhesives. For example, the bottom surface 108 may be made from material that is more conducive to preventing slippage while the top surface is made from material that is more conducive for providing comfort and/or absorbency. Alternatively, the mat 102 may be constructed from a single piece of material and a cover 200 may be utilized to lay on top of or envelope the mat 102 so as to provide the proper material for the top and bottom surfaces to provide the proper function, i.e. comfort, absorbency, or non-slip surface.

The top surface 106 of the mat 102 comprises a plurality of supports 104 strategically positioned so as to accommodate a user's upper limbs and/or lower limbs during an exercise to provide comfort and additional padding. The supports 104 each comprise a cushioning 110 material made from a fluid material, such as gas, air, liquid, water, oil, and the like; semi-rigid material, such as gel; and/or a solid material. If a solid material is used, the solid material may be a single piece, such as rubber, foam, fabric, and the like, or it may be a plurality of loose pieces, such as beads, feathers, plastic chips, and the like. Any other material or substance that absorbs shock is also suitable. For example, the cushioning material may be memory foam manufactured under the trademark Tempur-Pedic® or silica gel.

Figure 4:
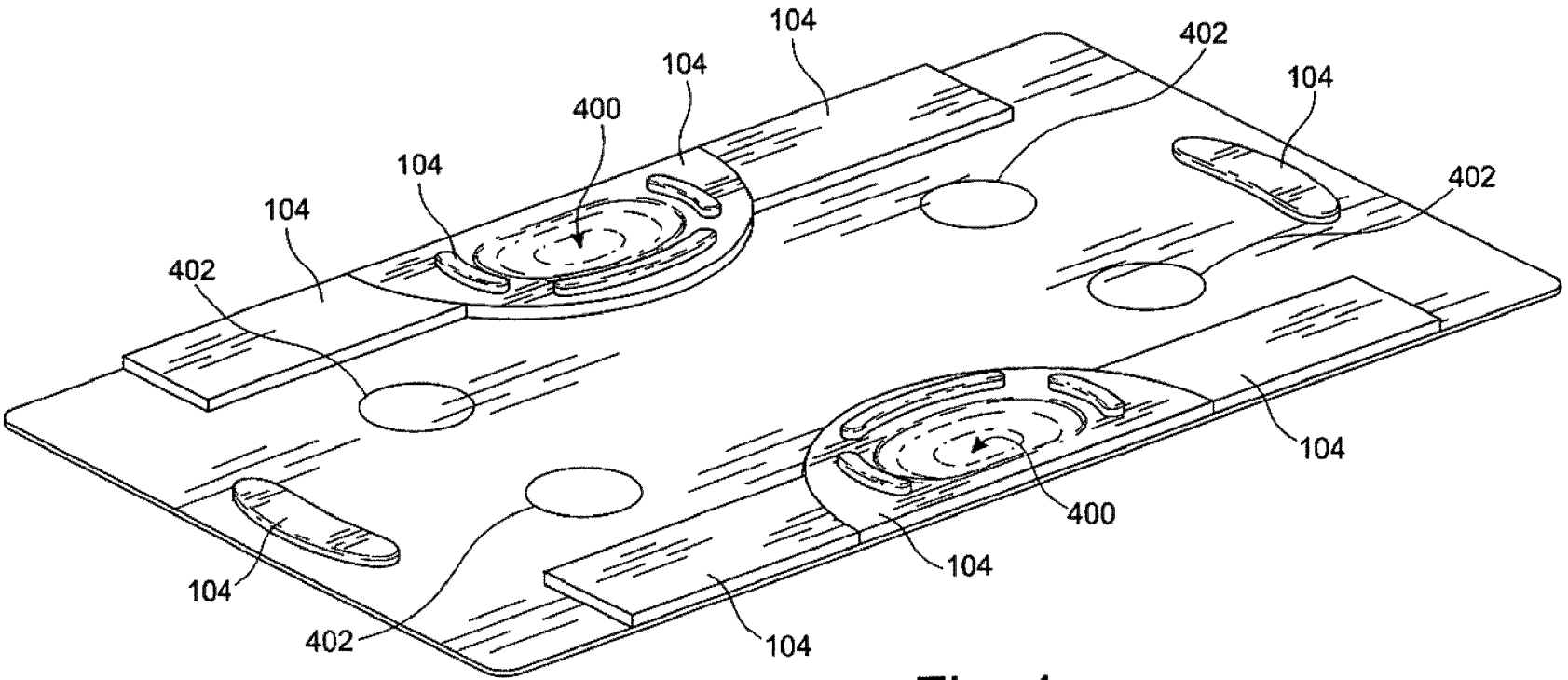
FIG. 4 shows a perspective view of another embodiment of the present invention.
Figure 5:
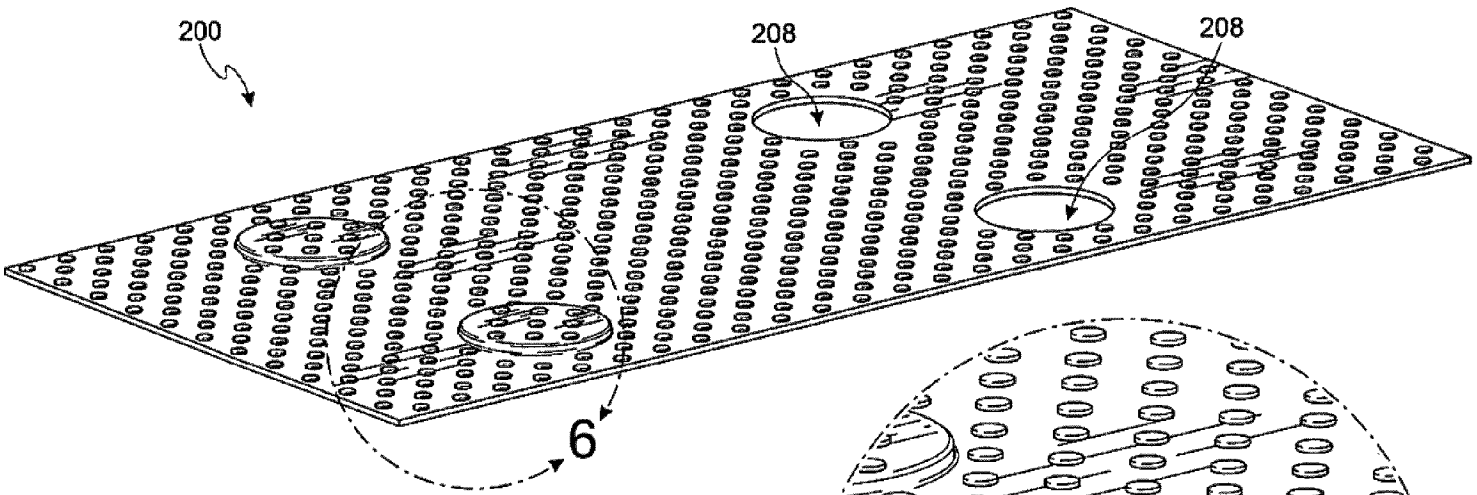
FIG. 5 shows a perspective view of an embodiment of the cover.
Figure 6:
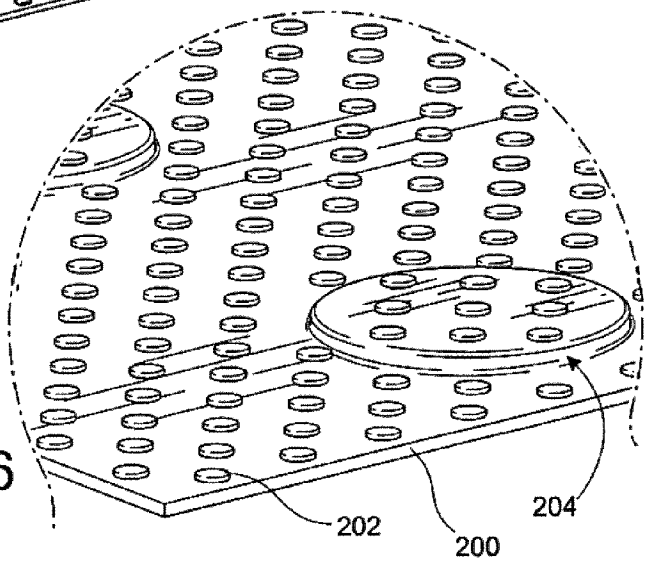
FIG. 6 shows a close-up of a pocket of the cover.
Figure 7:
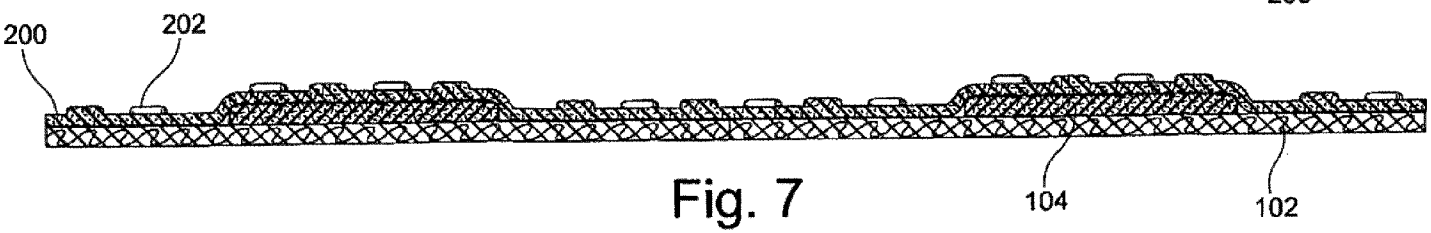
FIG. 7 shows a cross-sectional view of another embodiment taken through a support.

In some embodiments, the supports 104 may be dome-shaped or cylindrical in shape although any shape is suitable. Each support 104 may be of uniform shape and size for ease of manufacturing and transferability with other supports 104. In other embodiments, the supports 104 may come in a variety of shapes and any sizes to accommodate various body parts as shown in FIG. 4. The various body parts that may require support include upper limbs, such as the head, arms, shoulders, elbows, forearms, wrists, and hands; and lower limbs, such as the legs, thighs, knees, shins, ankles, and feet. For example, some supports 104 may be elliptical or oval in shape to accommodate an arm, while others are circular, rectangular, or square to accommodate the hands, knees, feet, or head. In some embodiments, the supports 104 may be contoured to fit specific body parts. For example, the support may have a concavity 400 or dip to receive an exerciser's upper or lower limbs. The concavity 400 may be in the general shape of the body part intended to be received. For example, if the support 104 is intended to receive the shin or forearm, the concavity 400 would be an elongated, elliptical or tubular shape. For knees, elbows, or the head, the concavity 400 may be bowl shaped. For the hands, the concavity 400 may be shaped like an open hand. Additional supports 104 may surround the concavity 400 to facilitate keeping the specific body part inside the concavity 400 during an exercise.

In some embodiments, the supports 104 may be permanently sealed, meaning that once the cushioning material 110 is inserted it cannot be removed without destroying the support 104. Alternatively, the supports 104 may have a closeable opening 112 through which the cushioning material 110 may be inserted and removed. For example, the closeable opening 112 may be a sealable hole or an opening closeable with a fastener. The opening 112 may be closed by any reversible fastening means such as zippers, buttons, hook-and-loop fasteners, and the like. This allows the cushioning material 112 to be removed, replaced, refilled, or otherwise properly maintained or adjusted.

In some embodiments, the supports 104 may be integrally formed into the mat 102 as shown in FIG. 3. In other words, the mat 102 and supports 104 are made from one continuous piece of material. At the area of the supports 104 an excess amount of material may be provided to increase the thickness of the supports 104 relative to the rest of the mat 102. For example, the mat 102 may be a single, flat piece of foam or rubber but at strategic location, an excess amount of the foam or rubber may have been formed to raise that area above the rest of the mat, thereby forming the support 104. As another example, the mat 102 may be a single, flat piece of textile or fabric material, such as a towel, with an excess amount of cotton or other material formed at strategic locations to form the support 104. If the supports are integrally formed into the mat, a variety of exercise mats 100 will have to be manufactured so as to provide the proper limb positioning of exercisers of different sizes.

In some embodiments, the supports 104 may be reversibly attachable to the mat 102 as shown in FIG. 2. In other words, removable supports may be fastened to the mat 102, and removed from the mat 102 without destroying the mat 102 or the support 104. For example, the bottom of the support 104 may comprise a fastener 206 to fasten to the top surface 106 of the mat 102. Suitable fasteners 206 include a hook-and-loop fastener, an adhesive material, a magnet, a highly resistive or other non-slip surface, and the like. The top surface 106 of the mat 102 comprises the reciprocal fastener material to attach with the fastener on the bottom surface of the support 104. This allows a single size mat 100 to be manufactured, while allowing the exerciser to position the supports according to his or her physical profile and the desired exercise. In some embodiments, the mat 102 may comprise a combination of removable and integrally fixed supports 104.

In some embodiments, the top surface 106 of the mat 102 may comprise a mark 402 so as to facilitate proper placement of the supports 104 for exercisers of different sizes, for different exercises, or for different body parts. These marks 402 can function as instructional tools to teach beginning exercisers where to properly position their limbs so as to perfect their body alignment during the exercise. Using suitable fasteners 206, exercisers can quickly and easily place and secure supports 104 on the proper mark 402 and when ready for a different position, move the supports 104 to the next proper mark 402.

For example, exercises may be performed on the exerciser's hands and knees or feet. A first pair of supports **104*a* may be positioned or fixed on the mat so as to accommodate placement of the hands in a comfortable position, such as approximately shoulder width apart. A second pair of supports 104*b* may be positioned away from the first pair of supports at a distance that accommodates the placement of the exerciser's lower limb, such as the knees or feet while the exerciser's hands are still on the first pair of supports. Each support in the second pair of supports 104*b* may be placed apart from each other at a distance comfortable to the exerciser. A third pair of supports (not shown) may be positioned apart from the first and second pair of supports to accommodate the positioning of any remaining body parts that may require support. For example, if the second pair of supports 104*b* accommodates the knees, the third pair of supports may be positioned to accommodate the feet, and vice versa. These placements may be integrally formed into the mat 102 by the manufacturer. In the removable support embodiment, these supports 104** may be positioned by the exerciser and secured in place using a fastener.

In some embodiments, the top surface 106 of the mat 102 may further comprise protuberances 202. The protuberances 202 serve to increase the friction between the user and the cover 200 to provide a non-slip surface. Preferably the protuberances 202 are spread throughout the mat 102. The protuberances 202 are much smaller in size than the supports 104 and much more frequent in number. In the preferred embodiment, the protuberances 202 are cylindrical in shape. The protuberances 202, however, may be any other shape, such as dome-like, pyramidal, conical, block-shaped, cubical, and the like.

In some embodiments, the exercise mat 100 may comprise a removable cover 200 positionable on the top surface 106 of the mat 102. The cover 200 may comprise a plurality of pockets 204 or cavities integrally formed into the cover 200 as a means for receiving a support 104. Each pocket 204 or cavity may align with one of the supports 104. Preferably, the shape of each pocket 204 or cavity is substantially similar to the shape of the support 104 so as to fit snugly on to the support 104. In some embodiments, the pocket 204 or cavity may be lined with an elastic band to better adhere to the supports 104. Other means to secure the pockets 204 onto the supports 104 may be utilized, such as magnets, hook-and-loop fasteners, adhesives, friction, clips, and the like.

In some embodiments, the cover 200 may comprise holes 208 through which the supports 104 are inserted and exposed as another means for receiving a support 104.

The cover 200 may be made from any type or combination of material, similar to the mat 102, such as textiles and fabrics, vinyl, rubber, silicone, plastics, polypropylene, polyurethane, synthetics, elastomers, polymers, and the like, or any other material that is absorbent and comfortable. Since the cover 200 will be the point of contact with the exerciser, the cover 200 should be comfortable to the touch. Furthermore, since the cover 200 serves as an outer covering, the cover 200 may be absorbent so as to absorb the sweat that falls onto the mat 100. The cover 200 may be removable and washable so that after use, the exerciser can quickly and easily remove the cover 200 from the mat 102 and have it cleaned.

The cover 200 may be a single layer to lay on top of the mat. In some embodiments, the cover 200 may be a double layer into which the mat 102 may be inserted. In the double layer embodiment, the cover 200 may also be a single integral piece or at least two separate pieces affixed together, for example, by stitching. Using at least two separate pieces allows one side of the cover 200 to be made from a comfortable, absorbent material while the other side may be made from a non-slip material. The double layer cover further comprises an opening through which the mat 102 may be inserted or removed. The opening comprises a fastener, such as a zipper, hook-and-loop fastener, snap buttons or the like to reversibly close the opening.

In embodiments utilizing the cover 200, the cover 200 may comprise protuberances 202, a textured surface, or some other non-slip material to provide a non-slip surface for the exerciser.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. An exercise mat, comprising:

a. a yoga mat, comprising:

i. a substantially planar top surface having a center; and ii. a substantially planar bottom surface opposite the top surface, wherein the bottom surface comprises a non-slip material;

b. a plurality of supports positioned on the top surface of the yoga mat and spaced apart from the center of the yoga mat and from each other so as to accommodate a user's upper limbs and lower limbs during an exercise, thereby creating an exposed top surface portion and a hidden top surface portion under the supports; and c. a cover positionable on the top surface of the yoga mat, the cover having a perimeter edge that is at least substantially coextensive with the exposed top surface portion of the yoga mat so as not to cover any side surface or the bottom surface of the yoga mat d. wherein the plurality of supports each comprise a cushioning material, and e. wherein the plurality of supports are contoured to receive a specific limb.

2. The exercise mat of claim 1, further comprising:

a. a first pair of supports positioned on the mat to accommodate placement of a user's upper limbs, the user's upper limbs selected from the group consisting of a hand, a wrist, a forearm, an elbow, and a head; and b. a second pair of supports positioned away from the first pair of supports at a distance that accommodates the placement of the exerciser's lower limb, the lower limb selected from the group consisting of a foot, an ankle, a shin, a knee, and a thigh.

3. The exercise mat of claim 1, wherein the supports comprise a closeable opening through which the cushioning material is insertable.

4. The exercise mat of claim 1, further comprising removable supports reversibly fastened to the yoga mat.

5. An exercise mat, comprising:

a. a yoga mat, comprising a perimeter edge and a center, the perimeter edge to the center defining a substantially planar top surface and a flat bottom surface opposite the top surface, the yoga mat defined by a top edge, a bottom edge opposite the top edge, a first side edge adjacent to the top and bottom edges, and a second side edge opposite the first side edge and adjacent to the top and bottom edges; and b. a first support and a second support positioned on and connected to the top surface of the yoga mat spaced away from the center of the yoga mat and from each other so as to accommodate a user's body part during an exercise, wherein the first and second supports each comprises a cushioning material and has a substantially flat top surface, wherein the first support is located along the first side edge and terminates before the top and bottom edges, and wherein the second support is located along the second side edge and terminates before the top and bottom edges.

6. The exercise mat of claim 5, wherein the cushioning material is selected from the group consisting of silica gel and foam.

7. The exercise mat of claim 5, wherein at least one support is contoured to receive a specific body part.

8. The exercise mat of claim 5, further comprising:

a. a first pair of supports positioned on the mat to accommodate placement of a user's upper limbs, the upper limbs selected from the group consisting of a hand, an elbow, a forearm, a wrist, and a head; and b. a second pair of supports positioned away from the first pair of supports at a distance that accommodates the placement of the exerciser's lower limb, the lower limb selected from the group consisting of a thigh, a knee, a shin, an ankle, and a foot.

9. The exercise mat of claim 5, further comprising a removable support having a fastener to reversibly attach the removable support to the yoga mat.

10. The exercise mat of claim 9, wherein the fastener is selected from the group consisting of a hook-and-loop fastener, an adhesive material, a magnet, and a highly resistive surface.

11. The exercise mat of claim 9, wherein the top surface of the yoga mat comprises a mark to identify proper placement of the removable support to accommodate the proper placement of the user's body part for performing a desired exercise.

12. The exercise mat of claim 5, wherein at least one support comprises a closeable opening through which the cushioning material is inserted and removed.

13. The exercise mat of claim 5 further comprising a plurality of protuberances on the top surface.

14. The exercise mat of claim 5 further comprising a cover having a means for receiving the first and second supports.

15. The exercise mat of claim 14, wherein the means for receiving the first and second supports is selected from the group consisting of a pocket and a hole.

16. The exercise mat of claim 14, wherein the cover comprises a plurality of protuberances to reduce slippage.

17. An exercise mat, comprising:

a. a yoga mat, comprising a substantially flat top surface having a center, and a flat bottom surface opposite the top surface, the yoga mat defined by a top edge, a bottom edge opposite the top edge, a first side edge adjacent to the top and bottom edges, and a second side edge opposite the first side edge and adjacent to the top and bottom edges, the yoga mat defining a longitudinal axis through the center and parallel to the first and second side edges, the yoga mat defining a lateral axis through the center and parallel to the top and bottom edges; and b. a plurality of supports positioned on the top surface of the mat and spaced away from the center of the mat so as to accommodate a user's body parts during an exercise, wherein each support of the plurality of supports comprises a cushioning material, wherein a first set of supports of the plurality of supports is located along the first side edge, passes through the lateral axis, and terminates before the top and bottom edges, wherein a second set of supports of the plurality of supports is located along the second side edge, passes through the lateral axis, and terminates before the top and bottom edges.

18. The exercise mat of claim 17, wherein, a first support within the first set of supports deviates medially towards the longitudinal axis, and a second support within the second set of supports deviates medially towards the longitudinal axis.

19. The exercise mat of claim 17, wherein at least one support is removably attached to the yoga mat by a fastener.

20. The exercise mat of claim 19, wherein the yoga mat further comprises a mark to identify proper placement of the at least one removable support to accommodate the proper placement of the user's body part for performing a desired exercise.

21. The exercise mat of claim 17, further comprising a cover.

22. The exercise mat of claim 21, wherein the cover further comprises a plurality of protuberances.

23. The exercise mat of claim 17, wherein the mat comprises a plurality of protuberances.

* * * * *